US006698497B1

(12) United States Patent
Streubel et al.

(10) Patent No.: US 6,698,497 B1
(45) Date of Patent: Mar. 2, 2004

(54) STRIP CASTING MACHINE COMPRISING TWO CASTING ROLLERS

(75) Inventors: Hans Streubel, Erkrath (DE); Heinrich Marti, Forch (CH); Jacques Barbé , Tarantaise (FR)

(73) Assignees: SMS Demag AG, Düsseldorf (DE); Main Management Inspiration AG, Hergiswil (CH)

( * ) Notice: Subject to any disclaimer, the term of this patent is extended or adjusted under 35 U.S.C. 154(b) by 0 days.

(21) Appl. No.: 10/049,738

(22) PCT Filed: Aug. 16, 2000

(86) PCT No.: PCT/EP00/07961

§ 371 (c)(1),
(2), (4) Date: Jun. 3, 2002

(87) PCT Pub. No.: WO01/14085

PCT Pub. Date: Mar. 1, 2001

(30) Foreign Application Priority Data

Aug. 20, 1999 (CH) ..... 1528/99

(51) Int. Cl.[7] ..... B22D 11/06

(52) U.S. Cl. ..... 164/428

(58) Field of Search ..... 164/428, 480

(56) References Cited

U.S. PATENT DOCUMENTS 4,702,300 A * 10/1987 Nakanori et al. ..... 164/155.4

FOREIGN PATENT DOCUMENTS

| | | |
|---|---|---|
| DE | 1939849 | 2/1970 |
| DE | 4202373 | 4/1993 |
| EP | 9428464 | 5/1991 |
| EP | 900607 | * 3/1999 |
| WO | 9723318 | 6/1997 |

* cited by examiner

*Primary Examiner*—Kuang Y. Lin
(74) *Attorney, Agent, or Firm*—Friedrich Kueffner

(57) ABSTRACT

The invention relates to strip casting machines comprised of two parallel casting rollers (1, 2) whose bearing journals (8, 9) are supported on a stand (3). Cooled roll barrels of the casting rollers (1, 2) and narrow lateral parts (5) delimit a casting gap (6). The aim of the invention is to obtain an optimal ratio between the width of the casting machine and the maximally castable strip width, to provide for a simple stand construction both for changing rollers as well as for exchanging narrow lateral parts, and to attain an improved protection against oxidation. To these ends, the invention provides that the cooled roll barrels are constructed as cylindrical casings (4). The casing (4) should be supported on a stationary axle, which is fixed on the stand (3), via the concentric support rings which project inside the casing (4) on both sides and which are connected to the same.

20 Claims, 2 Drawing Sheets

STRIP CASTING MACHINE COMPRISING TWO CASTING ROLLERS

BACKGROUND OF THE INVENTION

1. Field of the Invention

The invention relates to a strip casting machine, comprised of two casting rollers arranged essentially parallel to each other.

2. Description of the Related Art

It is well-known to produce by means of strip casting machines continuous strips of liquid melted metal, especially of melted steel. In this connection, the liquid metal is continuously fed to a casting gap defined by driven casting rollers. The liquid metal solidifies in front of and within the casting gap, and an at least partially solidified strip is removed by the casting rollers. This strip may be subjected to further continuous or discontinuous treatment like cooling, reheating, hot or cold rolling, profile transforming, surface treatment, trimming or the like.

It is also well-known in connection with strip casting machines, having two casting rollers arranged essentially parallel to each other, to delimit the casting gap with narrow lateral guides. Such narrow lateral guides can rest against end faces of the casting rollers or can be inserted between casing surfaces or roll barrels of the casting rollers and be arranged to be displaceable, for example, for adjusting the format of the strip. The casting rollers are arranged in a stand and can be displaced or pivoted essentially transversely relative to the longitudinal axis of the casting rollers in order to adjust the strip thickness. For cooling the liquid metals, the casting rollers, in particular, the roll barrels of the casting rollers, are cooled intensively by a cooling medium from the interior and/or from the exterior. Generally, the casting rollers are composed of different materials, wherein a material of high thermal conductivity is selected for the cooled roll barrels and a high strength steel is selected for bearing journals and roller core. The bearing journals, the roller core, and the roll barrels form a roller unit which can be set into rotation by means of a drive. The drive action is introduced into the bearing journals and transmitted by them onto the roll barrels. This configuration already known from classic rolling mill design or from the classic design of driving rollers for billet or slab continuous casting machines requires space laterally of the casting machine for the drives and thereby impairs the lateral access to the casting gap and to the narrow lateral guides delimiting the casting gap in its length. This known casting roller configuration also affects the configuration of the stand, the space requirement for multi-strand casting machines, the exchange of casting rollers and narrow lateral guides, the protection against oxidation of the liquid metal and of the cast strip, and the activities for operating and maintaining the machine.

SUMMARY OF THE INVENTION

In accordance with the present invention, the strip casting machine is composed of two casting rollers arranged parallel to each other, forming a casting gap delimited on both sides by narrow lateral guides, and a stand supporting the casting rollers, wherein the casting rollers are provided with cooled roll barrels forming the adjustable casting gap. Bearing journals are provided for supporting the casting rollers on the stand, wherein the cooled roll barrel is composed essentially of a cylindrical casing. The casing of each casting roller is supported on at least both sides thereof by support elements which are mounted rotatably on a stationary axle attached to the stand, wherein at least one of the support elements is drivable.

This object is solved according to the invention by the sum of the features of claim 1.

It is possible with the invention to position the casting roller drive such that the requirements stated in the object can be satisfied. Furthermore, the configuration of the roller can be better adjusted to the requirements of a casting roller in the sense of a cooled casting mold as can be seen from the subsequent description. In addition to the protection against oxidation of the metal feed, a protection against oxidation of the cast product, entailing corresponding quality improvements, is made possible more easily with the strip casting machine according to the invention.

The supporting members, on the one hand, can be a part of the casing, and/or, on the other hand, form a part of the stationary axle. All supporting members can also be a part of the cooled casing of the casting roller such that the casing with the supporting members forms a unitary member and is rotatably supported on the stationary axle. The supporting members are advantageously configured as concentric bearing rings connectable to the casing and supported on the stationary axle.

For example, the drive can engage the casing part of the casting roller directly or indirectly. An advantageous solution is accomplished when a first portion of the length of the bearing rings projects into the casing and is provided with cooling water inlet and outlet bores for cooling water circulation between the stationary axle and the casing. A second portion of the length of the bearing rings projects out of the casing and is provided at one side, at least, with bearing and drive members for a rotating movement of the casing, fixedly connected with the bearing rings, on the stationary axle. A straining ring with engaging keys is provided between the bearing rings and the casing.

The casting roller drive can be configured in many different ways according to the prior art solutions. An advantageous and simple solution results when a crown gear, being in active connection with a toothing of a stationary drive, is connected to the bearing ring. A driving gear, for example, can be flanged to the stationary axle.

As an alternative solution, it is suggested that one or several annular torque motors drive the casing by way of the bearing rings. Particularly advantageous is the drive of the casting rollers by means of a motor, preferably a brushless annular torque motor, arranged on or at the axle.

Various solutions are feasible for the supply and removal of the cooling medium through the stationary axle and the bearing rings relative to the casing of the casting rollers. For an advantageous configuration alternative, it is suggested to provide the bearing rings preferably with radial bores and grooves for feeding the cooling medium from the stationary axle to the casing. With this configuration, the stationary axle can be provided with axial bores on both sides and with radial bores at the end area of the axial bores which radial bores are aligned with the grooves of the bearing rings.

Also, the process of cooling the casing itself can be accomplished according to various prior art solutions for a circulation of the cooling medium. A simple and very cooling-effective solution results when the casing is provided across its circumference with bores for the circulation of a cooling medium, which bores are parallel to the longitudinal axis of the roller, wherein the direction of flow changes from bore to bore. The number of the bores must therefore be even.

In order to shorten the time required for changing the casting rollers, the stationary axle is provided with inlet and outlet means for the cooling medium, which simultaneously connect or disconnect inlet or outlet lines for the cooling medium when the rollers are placed onto or are lifted off the stand, and/or water clamping plates for feeding water and/or multi couplings for grease, energy supply, gas supply, for example, inert gas or air, and control are provided.

A simple and quick positioning and fixation of the casting rollers is accomplished when the stationary axle is provided on-both sides of the casing with a stop surface and a support face and when the stand is provided with stop and support surfaces for placing the casting rollers from above. For the fixation of the stationary axle, a swivel arm, for example, can be pivotably connected as a fastening means on both sides of the stand, respectively.

For calming the melted bath within the casting gap, an electromagnetic brake can be arranged between the rotating casing and the stationary axle. A particular advantage with regard to positioning and attaching such an electromagnetic brake is seen in that it can be arranged stationarily on the stationary axis.

BRIEF DESCRIPTION OF THE DRAWINGS

The invention will be further explained in the following with the help of configurational embodiments. It is shown in.

DETAILED DESCRIPTION OF THE PREFERRED EMBODIMENTS

Figure 1:
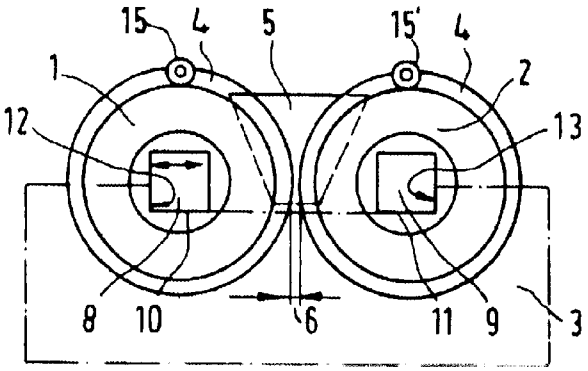
FIG. 1 a schematic view of a partially illustrated strip casting machine, and FIG. 2 a vertical section of a casting roller, FIG. 3 an enlarged detail of a casting roller with a cooled casing and a direct drive by means of an annular torque motor.

In FIG. 1, two casting rollers 1 and 2, arranged essentially parallel to each other, having cylindrical casings 4 are schematically arranged on a stand 3 which is indicated in a dash-dotted line. A casting gap 6, delimited on both sides of the casting rollers 1 and 2 by narrow lateral guides 5, is indicated by dimension lines. Such a casting gap 6 can measure between 1–15 mn, preferable 1.5–5 mm. Bearing journals 8, 9 of the casting rollers 1, 2 are configured at their support surfaces 10, 11 to be square-shaped. Stop surfaces 12, 13 of the bearing journals 8, 9 are utilized as roller stops on the stand 3. At least one of the stop surfaces 12, 13 of the bearing journals 8, 9 can be adjusted by means of position-controlled cylinders arranged within the stand 3 and provided for adjusting the desired casting gap. For simplification purposes, a double arrow is shown in FIG. 1 in this regard. Aligning the fixed roller can be accomplished by means of position-controlled cylinders. For this purpose, setting spindles can also be provided or other setting means acting similarly. Toothed wheels for driving the casting rollers 1, 2 are schematically shown with reference numerals 15, 15'. Such strip casting machines can be used for various casting metals, preferably for producing steel band.

Figure 2:
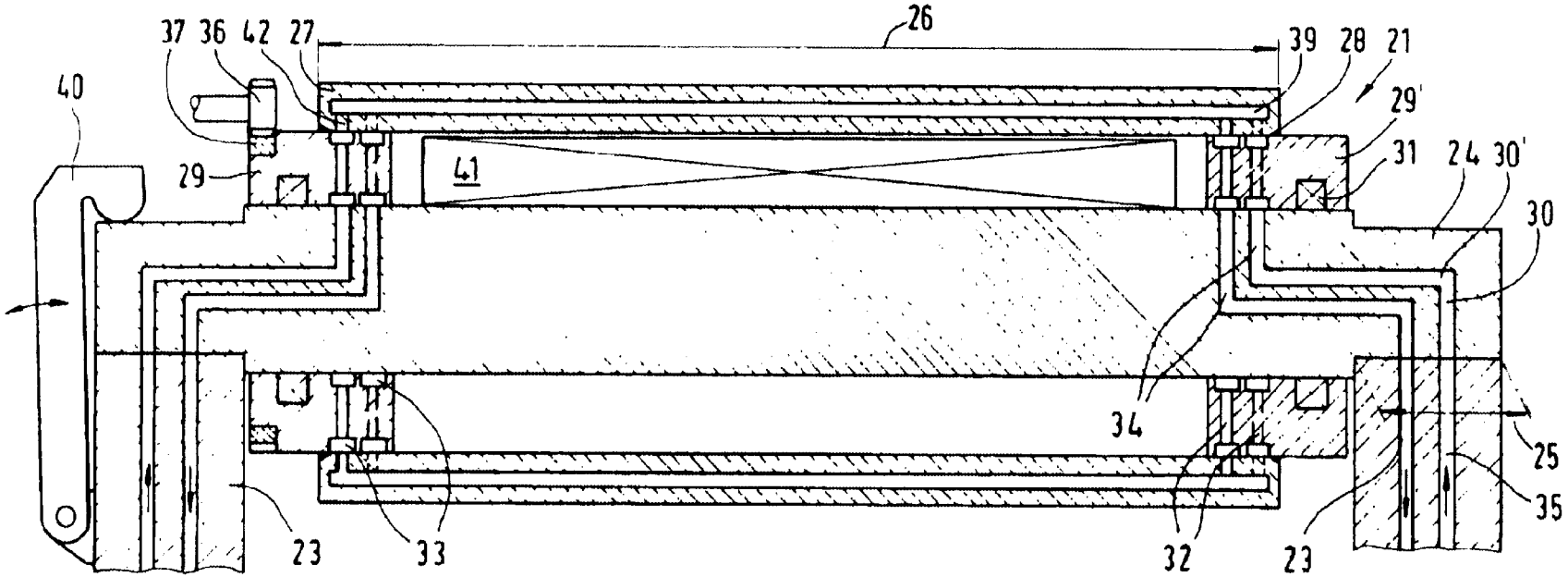

FIG. 2 illustrates with reference numeral 21 a casting roller on an enlarged scale compared to FIG. 1. The casting roller 21 is supported on a stand 23 which is only shown partially. A stationary axle 24 penetrating the entire roller 21 is supported with its square ends on the stand 23 across an approximate length 25. The length of a roll barrel of a casting roller 21 is indicated by an arrow head 26. This roll barrel is essentially comprised of a cylindrical casing 27 fixedly connected to two bearing rings 29, 29' by means of engaging keys 28 having a straining ring. The casing 27 is cooled by a cooling medium, preferably water. The two bearing rings 29, 29' are supported on the axle 24 by sliding bearings, ball bearings, or roller bearings 31. A first portion of the length of the bearing rings 29, 29' protrudes into the casing 27 and is provided with radial inlet and outlet bores 32 for cooling water, which bores open into grooves 33. The grooves 33 are aligned with radial inlet and outlet bores 34, 42 of the stationary axle 24 and of the casing 27. The cooling water is fed from the stand 23 into the bearing rings 29, 29' and into the casing 27 by way of further bore holes 30, 30' within the axle 24.

A second portion of the length of the bearing rings 29, 29' projects out of the casing 27 and the bearing ring 29 is in active connection with a drive, for example, a gear wheel drive 36, for the casting roller 21. The gear wheel drive 36, if desired, can be flanged to the stationary axle 24. It engages a crown gear 37 screwed down on the bearing ring 29. Instead of the illustrated gear wheel drive 36, 37, it is possible, as an alternative solution, to drive the casting roller 21 with one or several annular torque motors.

Cooling the roll barrels of the casting rollers or the cylindrical casings 27 across its circumference can be ensured by a circulation of cooling water through axially arranged bores 39.

Connecting and disconnecting the cooling water inlet or outlet to the casting rollers 21 takes place simultaneously with inserting into or lifting off the roller 21 from the stand 23 or by means of water clamping plates for water and/or multi couplings for the grease supply, energy supply, for the gas supply of, for example, inert gas or air, and for control.

For fixation of the stationary axle 21, a swivel arm 40 is, for example, pivotably connected to the stand 23 on both sides.

The configuration of the roller allows a particularly advantageous mounting of an electromagnetic brake 41 within the casting roller 21 between the stationary axle 24 and the rotating casing 27.

The electromagnetic brake is able to calm turbulences of the metal bath, in particular, of the bath surface above the casting gap. The electromagnetic brake is advantageously arranged to be stationary on the stationary axle.

In the case of casting rollers 21 for wider strips, the cylindrical casing 27 between the two bearing rings 29, 291 can be provided with additional bearing rings for supporting the casing 27 on the stationary axle 24. These additional bearing rings are also connected to the casing 27 and are radially or axially supported on the axle 24 by ball or roller bearings.

FIG. 2 illustrates the casing 27 as a cylindrical body. The casing 27, without deviating from the inventive subject matter, can also have a slight crown bow or conical shape, and the like.

Figure 3:
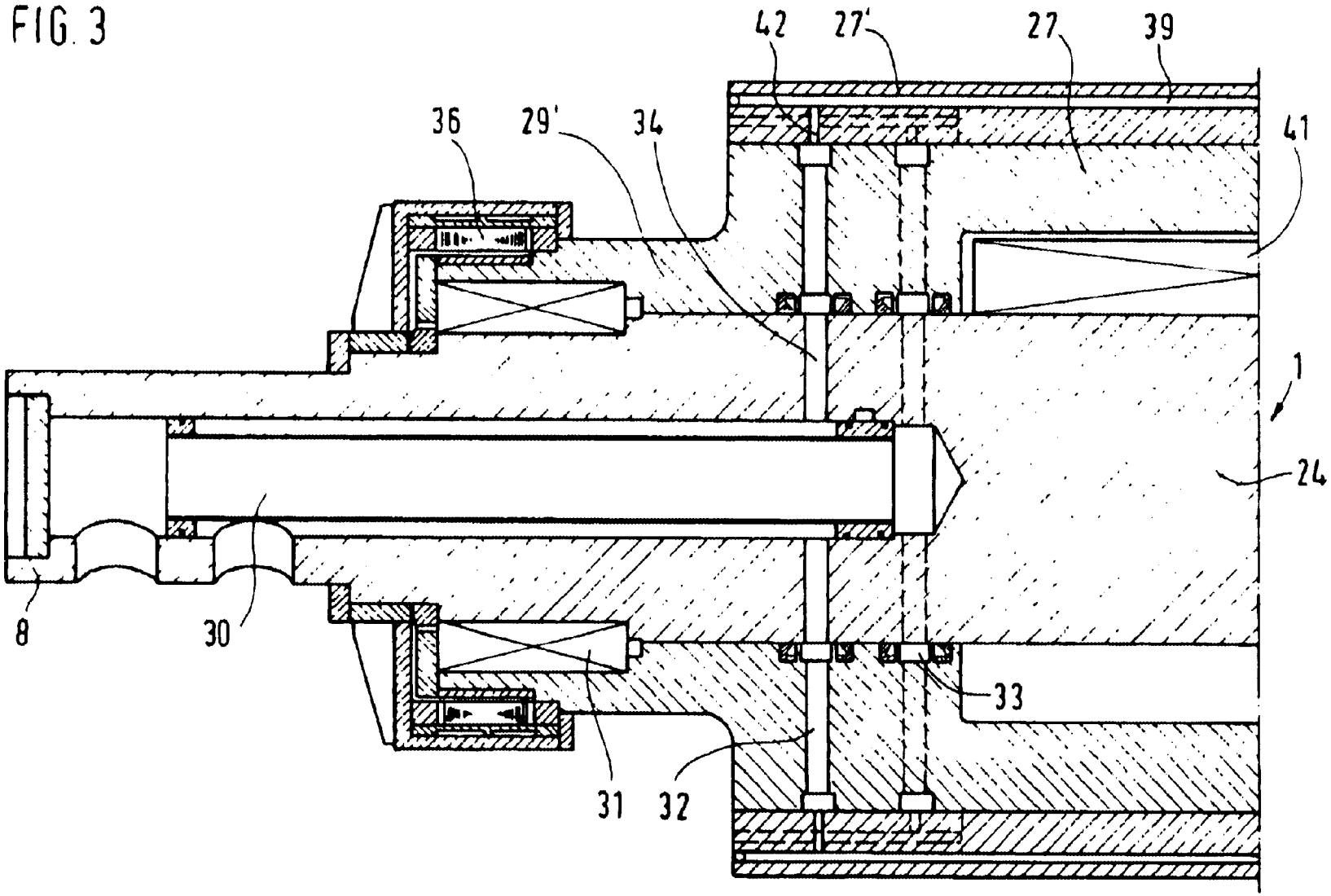

FIG. 3 shows the enlarged detail of a side of the casting roller 1. Here, the cooled casing is configured of two parts. The casing part 27' comprising the hot casing roll barrel is cooled by means of axially extending bores 39 carrying cooling means. The other casing part 27 form together with a supporting element 29' a nuitary part. Both casing parts 27, 27' are abvantageously connected with each other by way of electron-beam welding. The casing part 27 or its supporting element 29' is rotatably supported on the stationary axle 24 by means of the bearing elements 31. The drive of the casting roller configured in this way is preferably effected by a brushless annular torque motor 36 arranged directly on the axle 24. The inlet and outlet means 30 for cooling medium, drilled into the axle 24, are also clearly shown. The other side of the casting roller, which is not shown, is configured correspondingly with or without a drive.

What is claimed is:

1. A strip casting machine comprised of two casting rollers arranged parallel to each other and forming an adjustable casting gap delimited on both sides by narrow lateral guides, a stand supporting the casting rollers, wherein the casting rollers have cooled roll barrels forming the adjustable casting gap, and wherein bearing journals are provided for supporting the casting rollers on the stand, wherein the cooled roll barrel is comprised essentially of a cylindrical casing, and wherein the casing of each casting roller is at least at both ends thereof supported by support elements mounted on a stationary axle fixedly connected to the stand, and wherein at least one of the support elements is drivable.

2. The strip casting machine according to claim 1, wherein the support elements rotatably arranged on the stationary axle protrude at both ends into the casing.

3. The strip casting machine according to claim 1, wherein the support elements are concentrical bearing rings connected to the casing.

4. The strip casting machine according to claim 1, wherein the supporting elements form a part of the casing.

5. The strip casting machine according to claim 3, wherein a first portion of a length of the bearing rings projects into the casing and is provided with inlet and outlet bores between the stationary axle, and the casing for circulation of a cooling medium, and wherein a second portion of the length of the bearing rings projects from the casing and is provided with bearing elements and drive elements for a rotational movement of the casing.

6. The strip casting machine according to claim 3, wherein one of the bearing rings has a crown gear which meshes with a toothing of a stationary drive.

7. The strip casting machine according to claim 6, comprising at least one annular torque motor for driving the casing via the bearing ring.

8. The strip casting machine according to claim 1, wherein the bearing rings are provided with radial bores and grooves for feeding the cooling medium from the stationary axle to the casing.

9. The strip casting machine according to claim 8, wherein the stationary axle is provided on both ends with axial bores and with radial bores aligned with grooves of the bearing rings.

10. The strip casting machine according to claim 1, wherein the casing is provided across its circumference with axially arranged bores for a circulation of the cooling medium.

11. The strip casting machine according to claim 3, comprising engaging keys having a straining ring provided between the bearing rings and the casing.

12. The strip casting machine according to claim 1, wherein the stationary axle has inlet and outlet means for the cooling medium, wherein the inlet and outlet means simultaneously connect or disconnect inlet and outlet lines for cooling medium in the stand when the casting roller is inserted into or lifted off the stand.

13. The strip casting machine according to claim 1, wherein the stationary axle is provided on both sides of the casing with a stop surface and a support surface.

14. The strip casting machine according to claim 1, further comprising locking elements for fixedly securing the stationary axle to both sides of the stand.

15. The strip casting machine according to claim 1, wherein an electromagnetic brake for a metal bath between the rollers is arranged between the rotatable casing and the stationary axle.

16. The strip casting machine according to claim 15, wherein the electromagnetic brake is arranged within the casting roller and stationarily on the stationary axle.

17. The strip casting machine according to claim 1, wherein a drive of the casting rollers is effected by means of a motor arranged on or at the axle.

18. The strip casting machine according to claim 17, wherein the motor is a brushless annular torque motor.

19. The strip casting machine according to claim 1, wherein the casing is configured as a single piece or of multiple pieces.

20. The strip casting machine according to claim 19, wherein the casing pieces are connected by an electron-beam weld joint.

* * * * *